US009540124B2

(12) United States Patent
Petrini

(10) Patent No.: US 9,540,124 B2
(45) Date of Patent: Jan. 10, 2017

(54) APPARATUS, SYSTEM, AND METHOD FOR DISPENSING, RECEIVING, CLEANING AND/OR FILLING A CONTAINER

(75) Inventor: Thomas L. Petrini, Irwin, PA (US)

(73) Assignee: EVIVE STATION LLC, Pittsburgh, PA (US)

( * ) Notice: Subject to any disclaimer, the term of this patent is extended or adjusted under 35 U.S.C. 154(b) by 880 days.

(21) Appl. No.: 13/876,090

(22) PCT Filed: Oct. 4, 2011

(86) PCT No.: PCT/US2011/054802

§ 371 (c)(1),
(2), (4) Date: Jun. 5, 2013

(87) PCT Pub. No.: WO2012/047916

PCT Pub. Date: Apr. 12, 2012

(65) Prior Publication Data

US 2013/0240079 A1 Sep. 19, 2013

Related U.S. Application Data

(60) Provisional application No. 61/389,418, filed on Oct. 4, 2010.

(51) Int. Cl.

| | |
|---|---|
| ***B65B 1/04*** | (2006.01) |
| ***B65B 3/04*** | (2006.01) |
| ***B67D 1/00*** | (2006.01) |
| ***B67D 1/07*** | (2006.01) |
| ***B08B 9/32*** | (2006.01) |
| ***G07F 7/06*** | (2006.01) |

(Continued)

(52) U.S. Cl.

CPC . *B65B 3/04* (2013.01); *B08B 9/32* (2013.01); *B67D 1/0003* (2013.01); *B67D 1/0021* (2013.01); *B67D 1/07* (2013.01); *G07F 7/0609* (2013.01); *G07F 13/00* (2013.01); *B08B 9/0821* (2013.01)

(58) Field of Classification Search

CPC ..... B08B 9/0813; B08B 9/0821; B67D 1/07; G07F 7/0609

USPC ..... 141/91, 94, 173, 174; 134/144, 152

See application file for complete search history.

(56) References Cited

U.S. PATENT DOCUMENTS 5,000,345 A * 3/1991 Brogna ..... B67D 1/00 141/103

5,106,428 A 4/1992 Goerss et al.

(Continued)

FOREIGN PATENT DOCUMENTS

| | | |
|---|---|---|
| EP | 0774738 | 10/1996 |
| JP | 2003233859 | 8/2003 |

OTHER PUBLICATIONS

Partial Search Report issued for corresponding European Patent Application No. 11831474.9.

*Primary Examiner* — Jason K Niesz

(57) ABSTRACT

A vending machine comprising multiple subsystems typically including container receiving, container cleaning, container storage, container filling, container vending, a computer system, and a user interface A vending machine for dispensing, receiving, cleaning and/or filling containers comprising container receiving means for receiving a first container; container cleaning means for cleaning the first container; container dispensing means for dispensing the first container; and container filling means for filling the first container or a second container.

18 Claims, 7 Drawing Sheets

(51) Int. Cl.
*G07F 13/00* (2006.01)
*B08B 9/08* (2006.01)

(56) References Cited

U.S. PATENT DOCUMENTS

| | | | | |
|---|---|---|---|---|
| 5,419,348 | A | 5/1995 | Kuta | |
| 5,505,220 | A * | 4/1996 | Gorecki | B44D 3/006 134/138 |
| 5,630,493 | A | 5/1997 | DeWoolfson et al. | |
| 6,609,102 | B2 | 8/2003 | Kolls | |
| 7,325,556 | B2 * | 2/2008 | Walter | B44D 3/006 134/138 |
| 7,571,586 | B1 | 8/2009 | Morales | |
| 2003/0079612 | A1 | 5/2003 | Con | |

* cited by examiner

APPARATUS, SYSTEM, AND METHOD FOR DISPENSING, RECEIVING, CLEANING AND/OR FILLING A CONTAINER

CROSS REFERENCE TO RELATED APPLICATIONS

This application claims the benefit of the filing date of U.S. provisional patent application Ser. No. 61/389,418, filed on Oct. 4, 2010, the entirety of which is incorporated herein by reference for all purposes.

FIELD OF THE INVENTION

The field of the invention is vending machines, and more particular reference to vending machines dispensing water.

BACKGROUND

The demand for clean drinking water has led to various products designed to dispense pure water. Machines are available for purifying water. These machines may comprise carbon and ultraviolet (UV) filtering and/or reverse osmosis systems. Vending machines are available to which users can bring container to fill and pay by volume. No dispensing vending machines have internal vending, an internal cleaning system, and an automated account system.

SUMMARY OF THE INVENTION

It would be desirable for environmental and economical purposes to have a recycling vending machine that accepts containers, cleans the containers, dispenses the containers and fills the containers. The recycling of containers will decrease the number of disposable containers sent to landfills.

One solution is a first aspect to have a vending machine for dispensing, receiving, cleaning and/or filling containers comprising a container receiving means for receiving a first container, a container cleaning means for cleaning the first container, container dispensing means for dispensing the first container, and container filling means for filling the first container or a second container. A preferred embodiment of the first aspect further comprises container storage means for storing the first container from the container cleaning means. In another preferred embodiment, the vending machine further comprises a fluid disposal and/or recycling means for fluids from the container cleaning means, wherein the container filling means fills the first container or second container with a fluid, liquid or beverage. In a more preferred embodiment, the vending machine further comprises computer control means interfacing with the container cleaning means. In a still more preferred embodiment of the first aspect, the vending machine further comprises a user interface means interfacing with the container receiving means and container dispensing means. An even more preferred embodiment has the user interface means comprising a display. Another preferred embodiment has container identification means, preferably identification means are by RFID or bar code.

A second aspect of the invention is a system for dispensing, receiving, cleaning and/or filling containers comprising a vending machine comprising container receiving means adapted to receive a container, container cleaning means to receive the container from the container receiving means, container dispensing means to dispense the container after the container cleaning means, computer control means to control the container cleaning means and container dispensing means, user interface means to control the computer means; and container filling means controlled by the user interface means.

A preferred embodiment of the second aspect has audio and/or visual media played for a user by the user interface means while a container is being dispensed, received, cleaned and/or filled. A more preferred embodiment of the second aspect has the media comprising an advertisement. A still more preferred embodiment has the audio and/or visual media comprising an advertisement selected specifically for the user based upon the user's profile. As yet another preferred embodiment has revenue is received for playing the audio and/or visual media to the user. More preferred is wherein revenue is received for playing the audio and/or visual media to users offset costs associated with the vending machine.

A third aspect of the present invention is a method for dispensing, receiving, cleaning and/or filling containers, the method comprising the steps of identifying a container; inserting the container; cleaning the container; dispensing the container, and further comprising presenting of media during at least one of the previous steps. A preferred embodiment of the third aspect has the media comprising an advertisement targeting a specific user. A more preferred embodiment of the third aspect further comprises the step of filling the container.

A fourth aspect of the invention is a method for cleaning containers. The method preferably comprises inside and outside of a container with a fluid through a plurality of jets, at least one of the jets at an angle such that the container rotates on a longitudinal axis of the container. More preferably, the angle is oblique to the longitudinal axis.

These and other advantages of the invention will be appreciated by reference to the detailed description of the preferred embodiment(s) that follow.

BRIEF DESCRIPTION OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE INVENTION

Figure 1:
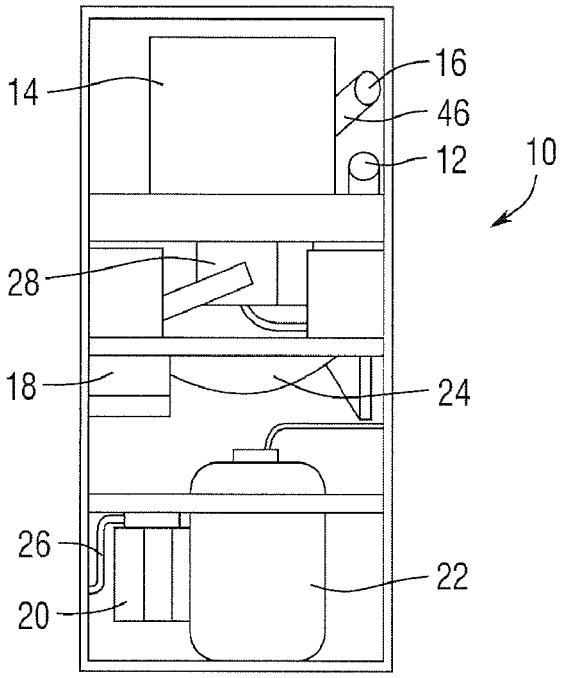
FIG. 1 is a front view of the vending machine according to a preferred embodiment of the present invention with the front, rear and side panels removed.
Figure 2:
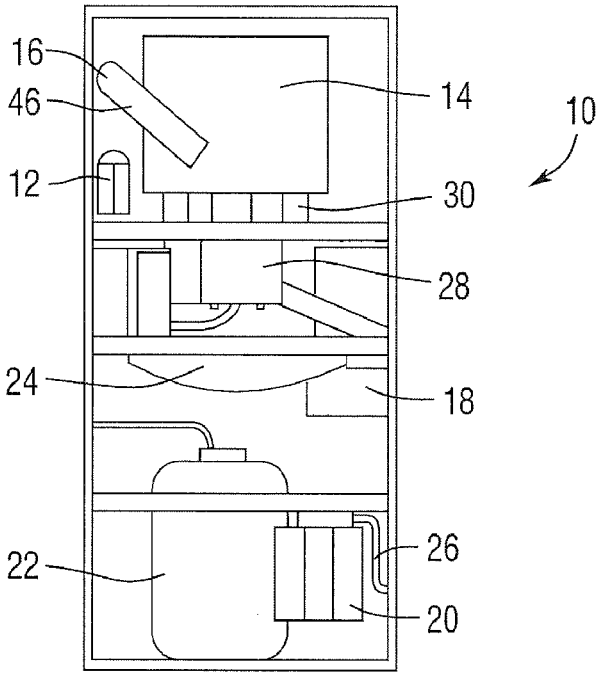
FIG. 2 is a rear view of the vending machine according to a preferred embodiment of the present invention with the front, rear and side panels removed.

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed. The following description is, therefore, not to be taken in a limited sense, and the scope of the inventive subject matter is defined by the appended claims and their equivalents.

The invention comprises a vending machine (10) for dispensing, receiving, cleaning and/or filling containers. As illustrated in FIGS. 1-12, a first aspect of the vending machine (10) has container receiving means, container filling means, container cleaning and/or disinfecting means, and container dispensing means.

The container receiving means may comprise a container depository means (16) and a container identification/scanning means. In some embodiments, the container identification/scanning means is in the container filling means (12). In other embodiments, the container identification/scanning means is in the container depository means (16). In preferred embodiments, the container identification means is behind a front panel (42) that is transparent to radio waves. In still other embodiments, the container identification is by means of a user interface means (14) having a keypad (44). In yet other embodiments, the container identification means is on a card carried by the user. For example, the container identification means may scan college or gym identification badges for ownership. The scanning means may be by any known method, including utilizing a bar code reader, magnetic strip reader, or radio frequency identification (RFID) detector.

The containers (52) for use with the invention may have an RFID tag or barcode attached. Preferably, a passive RFID chip is embedded in every container (52). The containers (52) may comprise water bottles, and the containers may have attachable lids (56).

The depository means (16) may comprise sliding means (46). The sliding means may comprise a section of tube that has been curved to shape. More preferably, the tube has a 4' diameter. In a preferred embodiment, the container is placed open end first in a top part of the tube, where the container slides further into the vending machine (10). In some embodiments, before or upon insertion, the identification or scanning means is used to identify the container. In other preferred embodiments, the depository means (16) is a chamber (48), the chamber having a door (50).

Figure 11B:
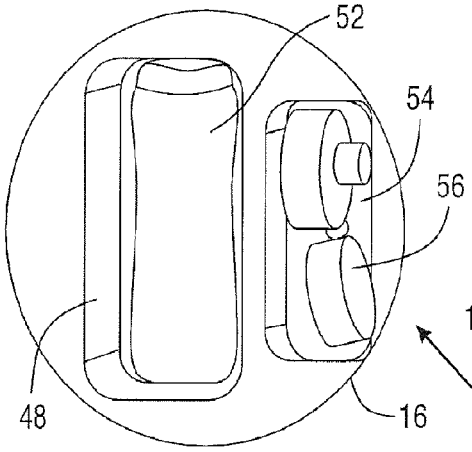
FIGS. 11B and 11C are illustrations of a preferred embodiment of the present invention in use.

In embodiments having a depository means (16) comprising sliding means (46), the container slides from the depository means (16) to a container cleaning and/or disinfecting means. In preferred embodiments having a depository means (16) comprising a chamber (48), the container is positioned on or rotated to a container cleaning and/or disinfecting means (FIGS. 11*b*, 11*c*).

Figure 3:
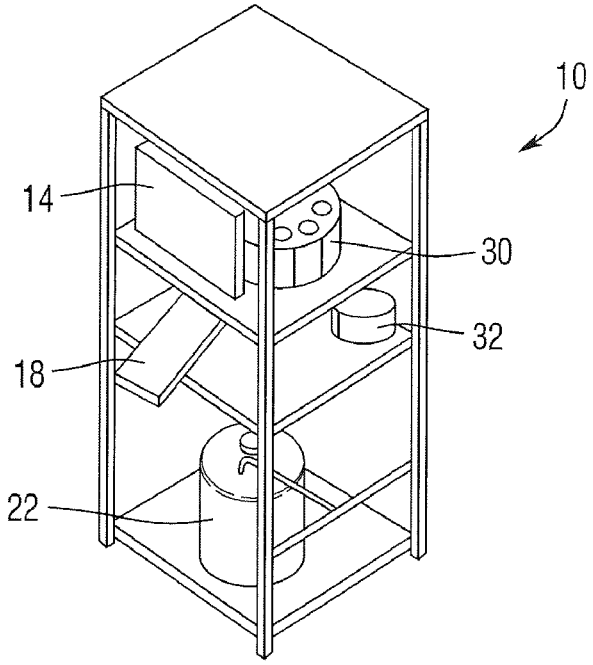
FIG. 3 is a front and right side perspective view of the vending machine according to a preferred embodiment of the present invention with the front, rear and side panels removed.
Figure 6:
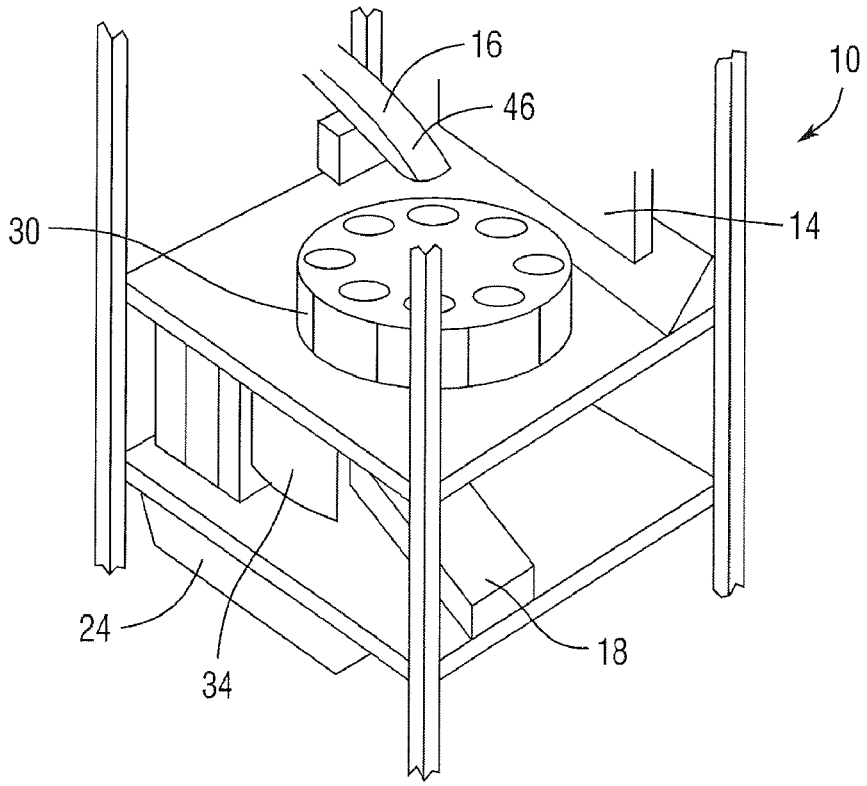
FIG. 6 is a front and right side perspective view of the vending machine according to a preferred embodiment of the present invention with the front, rear and side panels removed.
Figure 8:
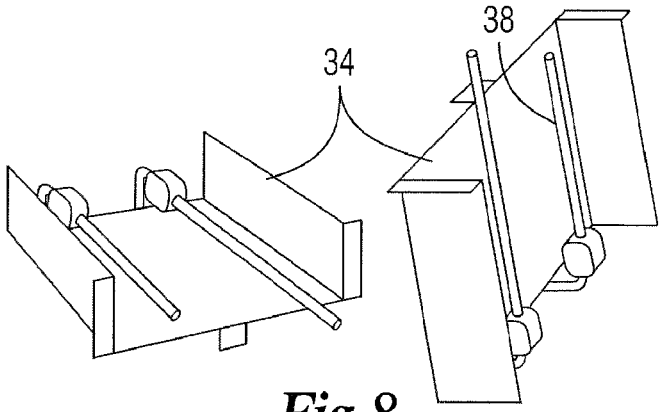
FIG. 8 is two perspective views of a steam and UV cleaning element according to a preferred embodiment of the present invention.

The container cleaning and/or disinfecting means may comprise container cleaning apparatus (30), container cleaning means (28) and fluid/material basin means (24). The container cleaning means (28) may further comprise a steam generator (32) as shown in FIG. 3. The container cleaning means (28) may further comprise a high-pressure steam/UV cleaning apparatus (34) as shown in FIG. 6 and FIG. 8. More preferably, the container cleaning means (28) comprises a hot water treatment followed by a disinfectant treatment. Yet more preferably, the hot water treatment uses water at least 120° F., and the disinfectant treatment comprises an aqueous chlorine solution. Preferably, the vending machine (10) may clean a plurality of containers simultaneously. More preferably, the vending machine (10) cleans a single container at a time.

Figure 5:
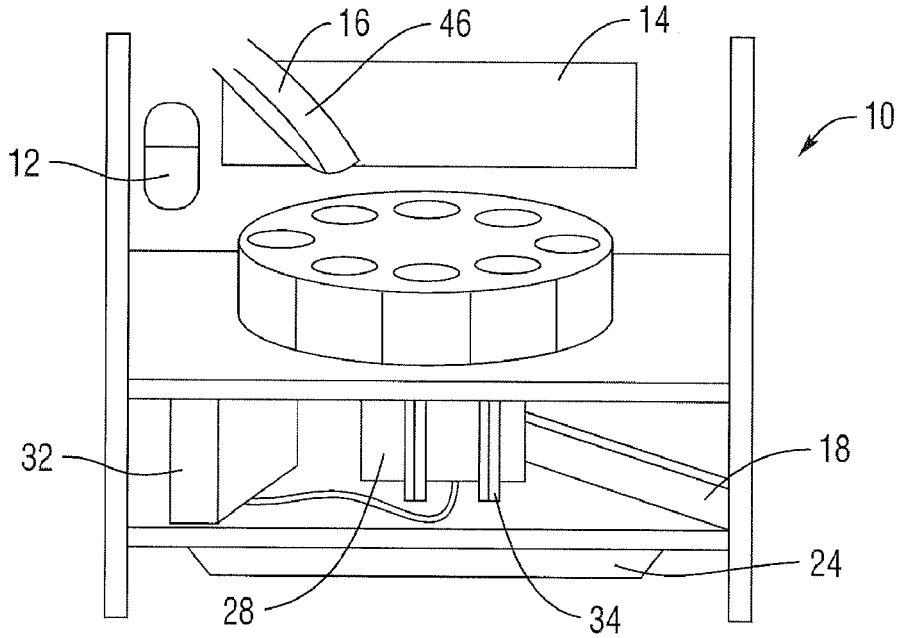
FIG. 5 is a rear view of a portion of the vending machine according to a preferred embodiment of the present invention with the front, rear and side panels removed.

In a preferred embodiment of the present invention, the container cleaning apparatus (30) comprises a carousel for positioning the containers in an upside-down almost vertical position with the container opening positioned to drain fluids by gravity. The container receiving means (16) are positioned above the container cleaning apparatus (30) as shown in FIG. 5, to allow a container to arrive from the container receiving means (16) and be placed in the container cleaning apparatus (30) by gravity.

Figure 11A:
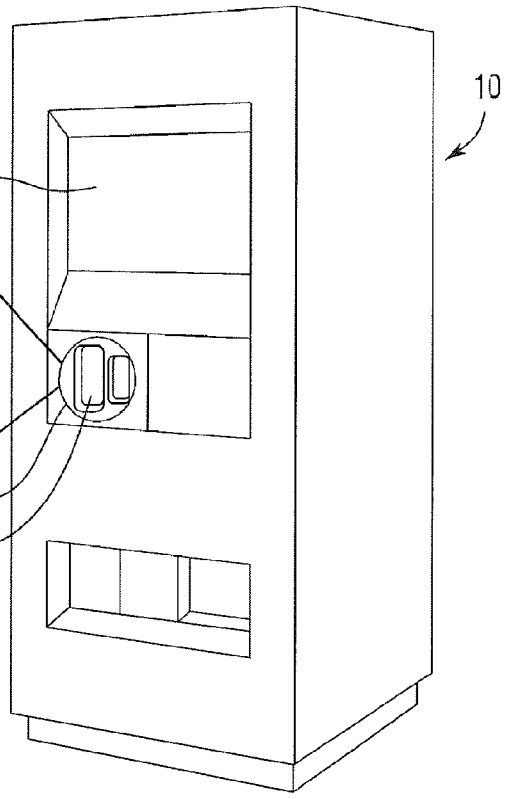
FIG. 11A is a front and right perspective of another preferred embodiment of the present invention.
Figure 11C:
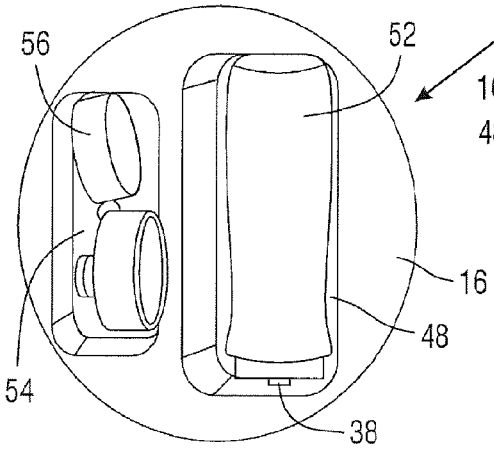

In a more preferred embodiment of the present disclosure, the container cleaning apparatus (30) comprises a single container washing station for positioning a container (52) in an upside down almost vertical position with the container opening positioned to drain fluids by gravity (FIG. 11C). Referring to FIGS. 11A, 11B, and 11C, even more preferably, the container (52) may be placed into the depository means (16) comprising a first wash chamber (48) and the chamber is rotatable, allowing the container to invert to an upside down almost vertical position. In a still more preferred embodiment, the depository means further comprises a second wash chamber (54) for receiving and cleaning the attachable container lid (56).

The container cleaning means (28) of the vending machine (10) may comprise at least one instant hot water heater. In preferred embodiments, the at least one water heater can dispense about 10.8 gallons of water per hour at about 200° F. water. More preferably, the amount of water dispensed to the water cleaning system is automated by a computer means. Still more preferably, the computer means controls the flow of water into the heater via a solenoid valve. In some embodiments the at least one hot water heater heats a disinfecting solution.

Preferably, vinyl tubing may be used to route cold water throughout the vending machine (10). Also, preferably, copper tubing may be used to route the hot water and/or disinfecting solution from the at least one water heater to the cleaning area and to cleaning jets (38) of the container cleaning means (28). Below the cleaning areas, as well as the drying areas, is the fluid/material basin means (24) to collect the dirty water and direct it to the water return/outlet (26).

In some preferred embodiments of the present invention, a high-pressure steam/UV cleaning apparatus (34) is preferably located at least partially under the container cleaning apparatus (30), wherein as the container cleaning apparatus (30) rotates, the container (52) will pass over at least one cleaning jet (38) of high pressure steam from the high-pressure steam/UV cleaning apparatus (34). Preferably, a portion of the piping is encapsulated in UV lighting, whereby bacteria are killed.

Figure 7:
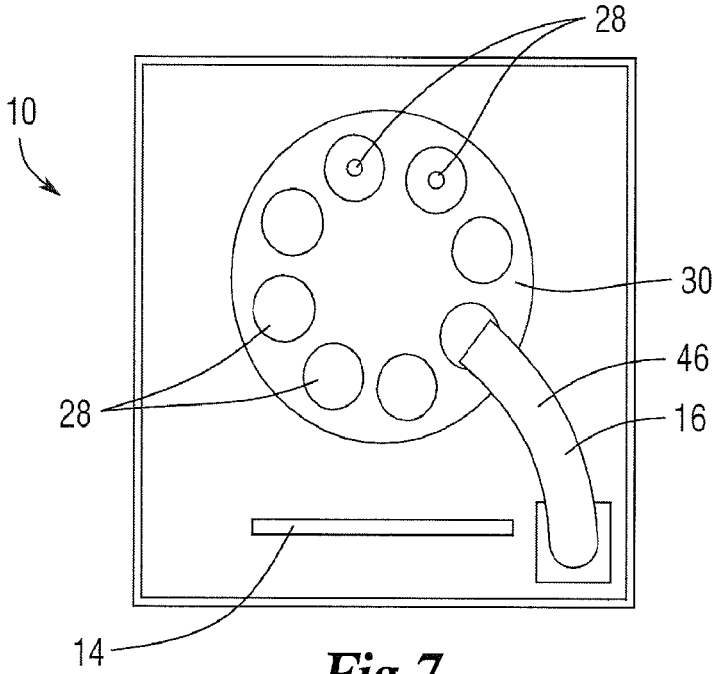
FIG. 7 is top view approximately midway from the top to the bottom of the vending machine according to a preferred embodiment of the invention.

In a preferred embodiment, the carousel system of the c rotates 45° each time a new container is inputted into the vending machine (10), allowing for a total of eight positions in the device, FIG. 7. The first two positions are for the container to be inputted and rotated once. In the next two positions, the containers are cleaned using hot water that is routed via copper tubing. The next two positions are to allow the inverted containers to drip dry. Finally, the last position of the track system contains a large hole to allow the containers to drop into the container storage means (36), shown in FIG. 9, which are preferably positioned within the vending machine (10) so that containers stored therein may be dispensed via container dispensing means (18) as shown in FIG. 6. The hot water cleaning process is run every time the carousel rotates 90°.

A rotating motor that is allowed to rotate 45° at a time may control the carousel system. The motor is preferably stopped by the placement of LED/photo detector circuits and reflective tape that recognize the angular position of the carousel.

In other preferred embodiments of the present invention, the container cleaning apparatus (30) comprised of a single container washing station has one inside jet (38) of the container cleaning apparatus (30) positioned inside the container and at least one outside jet (38) of the container cleaning apparatus outside the container. The at least one inside jets (38) have apertures to spray water and/or disinfectant solution to the inner surfaces of the container, and the at least one outside jets (38) have apertures positioned to spray water and/or disinfectant solution to the outer surfaces of the container. In still more preferred embodiments, at least one of the inside jets (38) or outside jets (38) are further positioned at an angle to impart an axial rotation of the container during spraying of water and/or disinfectant solution.

Figure 4:
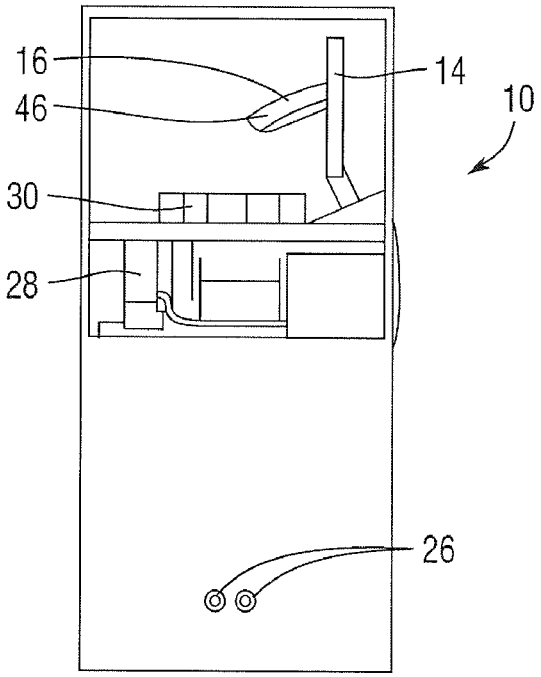
FIG. 4 is a left side view of the vending machine according to a preferred embodiment of the present invention with the front, rear and side panels removed.

The external inlet/outlet means (26) are preferably an input and output hook up for water connection to the vending machine (10), as shown in FIG. 4. The input hook up may attach to one end of a hose. Preferably, the water is filtered immediately upon entrance into the system. The output water out of the system preferably is set up so that overflow filtered water and the hot water used in cleaning merge to exit the system. Preferably, the overflow and hot water used in cleaning is recycled back through the system. More preferably, the overflow and hot water used in cleaning may be deposited into the public water system or a nearby septic tank. Even more preferably, the water will be recycled and used to grow plants nearby the vending machine (10).

The fluid/material basin means (24) collects water from the cleaning process, as illustrated in FIG. 7. The fluid/material basin means (24) preferably comprises a plastic paint tray. A sink drain and seal may be attached to the basin. The basin is located so as to collect water/fluids from a plurality of inputs, which may include, but is not limited to the cleaning apparatus (30), the container receiving means (16), and other areas where fluids are generated or transported. The basin means (24) is designed to collect and dispose of fluids via water outlet (26).

The container filling means may comprise a filtration system means (20), flavor additives (20), and external inlet/outlet means (26). A preferred filtration system means (20) is an ultra UV purifier. In filling, the vending machine (10) may dispense hot drinks, cold drinks, room-temperature drinks, or a combination of hot, cold, and room-temperature drinks. Hot drinks may include, but are not limited to, teas and coffees. Preferably, the heating to dispense hot drinks will utilize a steam generator (32). Cold drinks may include, but are not limited to water, juices, organic fruit drinks, and protein shakes. In some preferred embodiments, the dispensed drinks contain added vitamins from a vitamin powder or a vitamin syrup.

The containers to be filled by the container filling means may be supplied by the user or supplied by container dispensing means (18). The container dispensing means may comprise container dispensing means (18). In preferred embodiments, if the user desires the same container back that they put in they can request this option through the user interface (14). It is anticipated the option to receive the same container back from the container dispensing means (18) will not be a rapid as getting a container which has already been cleaned out of the container storage means (36). The container retrieval means is preferably a door providing access to the same container.

Figure 9:
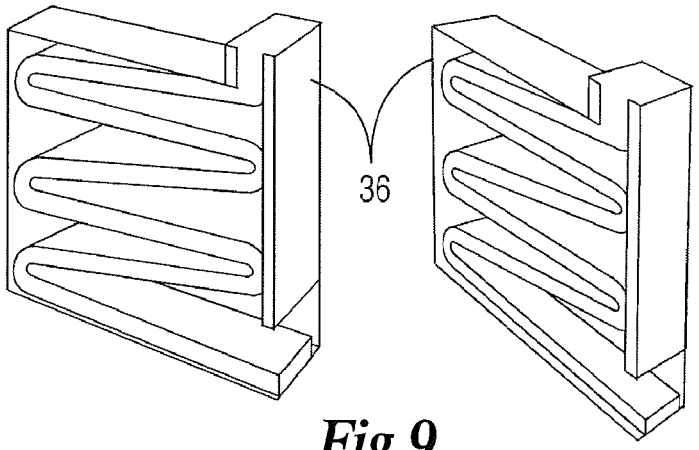
FIG. 9 is two perspective views of a container storage according to a preferred embodiment of the present invention.
Figure 10:
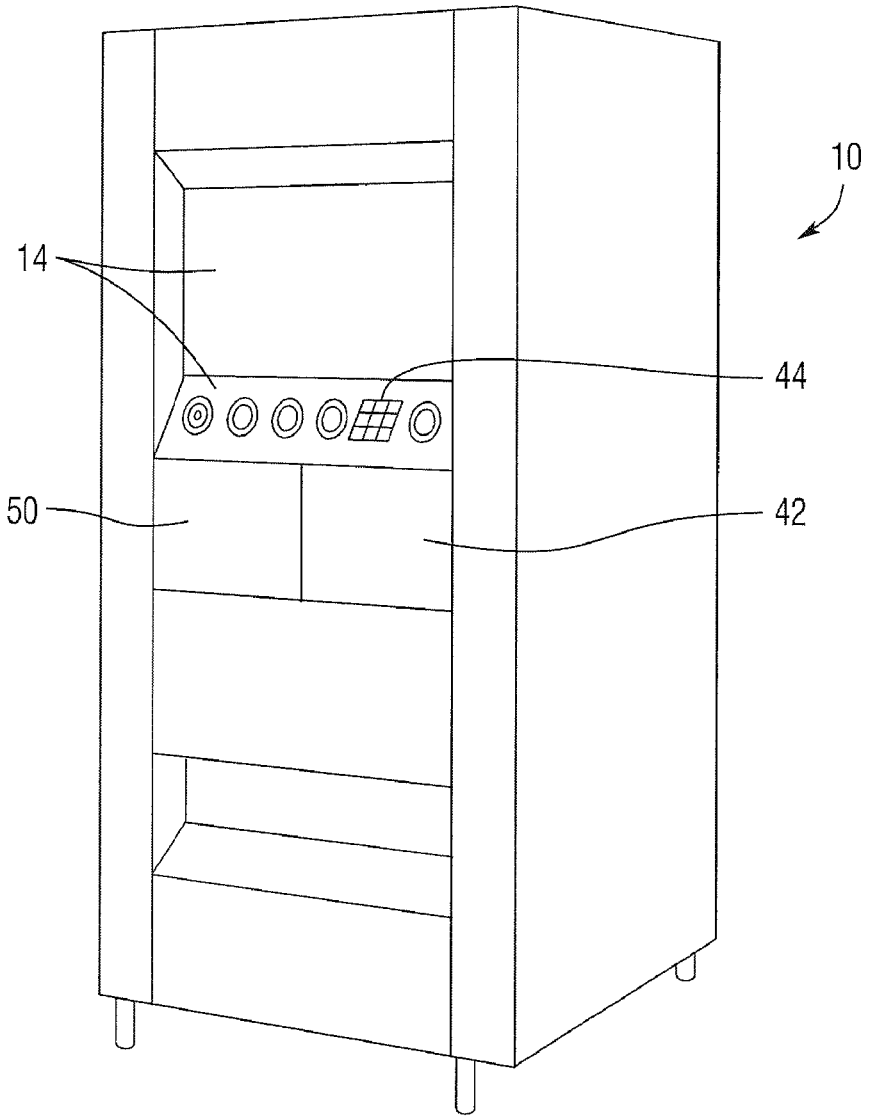
FIG. 10 is a front and right side perspective of another preferred embodiment of the present invention.

The first aspect may further comprise container storage means (36) as shown in FIG. 9. The container storage means (36) can be designed to hold as many containers or containers as desired. In a preferred embodiment, the container storage means (36) can hold about 55 (8 inch high by 3.65 inch diameter) containers which would occupy an approximate volume of 10 inches by 36 inches by 36 inches. In other preferred embodiments, the container storage means (36) can hold 100-200 containers.

Preferred embodiments have a computer control means integral to the user interface means (14) and the computer control means interfacing with the container cleaning means (28).

In preferred embodiments, the user's profile in the user interface (14) may dictate if the user is allowed to check out a container from the vending machine (10). As an example, this feature would be useful at a gym where above average quantities of beverages would be consumed. As another example, this feature would allow checking the container out in one city and checking in the container in another city.

The first aspect may further comprise fluid disposal and/or recycling means which may comprise an expansion tank (22) connected to the external inlet/outlet means (26). The purpose of the expansion tank (22) is to control system pressure and help reduce energy consumption of heating and chilled water operations. The expansion tank (22) may be connected after filters in the system.

The first aspect may further comprise a user interface means (14). The user interface means may comprise a display. The display may be multifunctional. In a preferred embodiment, the display is a touch screen. The touch screen may allow users to securely log into a profile, such as with a user name and password. The touch screen may further comprise a privacy film layer to ensure sensitive data is kept private. The touch screen may allow the user to purchase additional containers, update their profile, view or otherwise experience multi-media presentations. The multi-media presentations may include audio and or video clips, advertisement, music videos, and similar information.

The user interface means (14) may include an integrated webcam to contact customer service, wherein the customer service may provide immediate answers to concerns or questions. The user interface may allow a customer service representative to greet registered users by name and help with issues. Non-registered users may also utilize the user interface to contact customer service.

The user interface means (14) may include an option for a user to fill out a secure profile containing personal information, wherein the profile is stored securely on company servers. Preferably, advertisers will have the ability to upload advertisements and metadata associated with the advertisements. Even more preferably, once a user logs into the user interface means (14), an algorithm matches the identified user profile with the uploaded metadata and an advertisement is displayed based upon the user's profile. Even more preferably, the user will have the option to use the interface means (14) to rate the advertisement.

The vending machine (10) may dispense a printed coupon or digital coupon code based upon the user's interaction with the user interface means (14). Preferably, the vending machine (10) further comprises a printer for printing coupons. The revenue from the advertisements may be used to offset, partially or completely, the dispensing, cleaning, and drink costs associated with use of the vending machine (10). As an example, a company could offer one music download per water fill or a bank could add money to a user's savings account to encourage usage and rive product at the same time. This allows for more granular targeting.

The user interface means (14) may be adjustable for viewing. Preferably, the user interface means (14) will comprise a screen adjustable for the height of the user. Even more preferably, the height of the user will be available from the user profile and the adjustment will be automatic.

The user interface means (14) may interact with a front panel of the vending machine (10). Preferably, the interaction will be to make the front panel translucent and/or activate fiber optics behind the front panel.

The user interface means (14) may include means to add skins to the containers. Preferably, the skins will be personalized based upon the user's profile. More preferably, the skins will be based upon advertising related to the user's profile. In some embodiments, the skins will be vinyl wraps. More preferably, the skins will be paper. Even more preferably, the skins will be a biodegradable material.

The user interface means (14) may include a webcam. The webcam preferably allows interaction of the user with a customer service representative. The user interface means (14) may be wi-fi enabled. Preferably, the user interface means (14) will serve as a wireless hotspot. Even more preferably, the user interface means (14) will interface with digital applications (apps), wherein the apps could include functionality such as to indicate vending machine (10) locations, how much water has been consumed, how much water has been consumed versus friends. Yet even more preferably, the user interface means (14) will have social media integration to send messages to the user. The user interface means (14) may include charging capabilities for electronic equipment. Preferably, the charging capabilities allow charging of telephones. More preferably, the user interface means (14) will secure the telephones during charging.

A second aspect of the invention is a system for dispensing, receiving, cleaning and/or filling containers comprising a vending machine (10), container receiving means (16), container cleaning means (28), container dispensing means (18), computer control means, user interface means (14), and container filling means (12). Preferred embodiments have the computer control means integral in construction with the user interface means (14). In a preferred embodiment, the system comprises a vending machine (10) comprising container receiving means (16) adapted to receive a container; container cleaning means (28) to receive the container from the container receiving means (16); container dispensing means (18) to dispense the container after the container cleaning means (28); computer control means to control the container cleaning means (28) and container dispensing means (18); user interface means (14) to control the computer means; and container filling means (12) controlled by the user interface means (14).

Preferably, the second aspect of the invention, the user interface (14) presents media as the vending machine (10) while the container is being received, cleaned, dispensed, and/or filled. More preferably, the media is audio and/or visual media. More preferably, the media comprises an advertisement. Even more preferably, the advertisement is selected for a user based upon user data previously entered into the user interface or entered remotely. Preferably, revenue from playing the media offsets costs associated with the vending machine (10).

A third aspect of the invention is a method for dispensing, receiving, cleaning and/or filling containers. The method comprises the steps of scanning a container; inserting the container; cleaning the container; dispensing the container, further comprising presenting of media during at least one of the previous steps. Preferably, the media comprises an advertisement. More preferably, the advertisement targets a user. A preferred embodiment of the third aspect further comprises the step of filling the container.

Example

A user has entered personal information into a secure profile. The personal information of this example includes the user is 25 years old, male, athletic, he is interested in golf, prefers Nike brand over Taylormade brand goods and he provided his zip code. The user approaches the vending machine (10). The user logs onto the server using the user interface (14), or by scanning a container having a bar code or RFID chip. The user chooses one of the following options: (a) fill only; (b) return only; (c) get new container and fill; or (d) return and fill.

If the user has chosen option (a) fill only, the user places the scanned container under the container filling means (12). The user presses a button to indicate the container is in place. Based upon the user profile, displays a commercial for a new Nike driver, available at a local sporting goods store or online and a digital coupon for 20% off is then be uploaded to the user's profile for easy retrieval. The now filled container is removed by the user. The user is logged out of the user interface (14).

If the user has chosen option (b) return only, the return door of the container receiving means (16) is unlocked. The user opens the door and slides a container into the container receiving means (16). The container receiving means (16) scans the container.

If the user has chosen option (c) get new container and fill, the system verifies if a container is eligible. If eligible, the container is reassigned to the user. The new container drops out of the container dispensing means (18). The user removes the container and places the scanned container under the container filling means (12). The user presses a button to indicate the container is in place. Based upon the user profile, displays a commercial for a new Nike driver, available at a local sporting goods store or online and a digital coupon for 20% off is then be uploaded to the user's profile for easy retrieval. The now filled container is removed by the user. The user is logged out of the user interface (14).

If the user has chosen option (d) return and fill, the return door of the container receiving means (16) is unlocked. The user opens the door (50) and slides a container (52) into the container receiving means (16). A container (52) drops out of the container dispensing means (18). The user removes the container (52) and places the scanned container under the container filling means (12). The user presses a button on the user interface means (14) to indicate the container (52) is in place. Based upon the user profile, displays a commercial for a new Nike driver, available at a local sporting goods store or online and a digital coupon for 20% off is then be uploaded to the user's profile for easy retrieval. The now filled container is removed by the user. The user is logged out of the user interface (14).

In another preferred embodiment of the third aspect of the invention, the method comprises the steps of, in either order, inserting a container (52) into a vending machine (10), and scanning the container (52) for identification, and positioning the container such that the container is nearly vertical and upside-down; spraying hot water inside the container (52) and outside the container (52); spraying a disinfecting solution inside the container (52) and outside the container (52); drawing air about the container (52); repositioning the container (52) such that the container (52) is nearly vertical and right side-up; and dispensing a beverage into the container (52).

Figure 12:
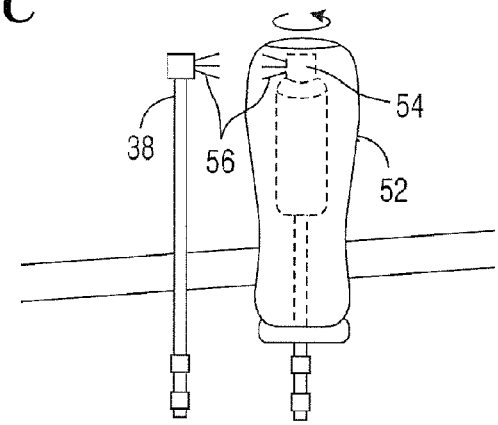
FIG. 12 is a side view of a preferred embodiment of the cleaning means of the present invention.

In a more preferred embodiment, the hot water and/or disinfecting solution from a first jet (38) causes the container (52) to rotate on its axis (FIG. 12). FIG. 12 illustrates a bottle (52) upside-down on a second jet (54), a spray of water and/or disinfecting solution from the second jet (54) cleans the inside of the container (52), while a first jet (38) sprays the outer surface of the container (52), the spray (56) from the first or second jet (38) or (54) directed to cause the container to rotate (58), whereby the whole of the inner and outer surfaces are cleaned.

In yet another aspect of the invention, a container (52) is cleaned by simultaneous spraying of a fluid inside and outside the container using a plurality of jets (38), wherein at least one jet (38) is directed off the longitudinal axis of the container, whereby the container (52) rotates on the longitudinal axis.

In even more preferred embodiments, the method further comprises dispensing vitamin tablets no more than once per day per user.

In any of the above aspects, the hot water is may be at least 120° F. In preferred aspects, the hot water is preferably 120° F. to 140° F. In any of the above aspects, the disinfecting solution may contain chlorine. Preferably, the disinfecting solution contains 50-100 ppm aqueous chlorine. More preferably, the chlorine is stored in the machine at 3-5% concentration and diluted prior to use. In any of the above aspects, the machine or method may contain a chiller tank in addition to a heater tank. In any of the above aspects, the container may comprise a bottle. Preferably, the container comprises a water bottle. Even more preferably, the water bottle is comprised of polycarbonate. In any of the above embodiments of the invention, the computer means may also control vitamin dispensing means from the vending machine (10). In more preferred aspects, the computer means controls the vitamin dispensing means whereby vitamins are dispense not more than once per day per user.

The vending machine (10) will require power. Preferably, the power generation will be using solar power. More preferably, the power generation will employ batteries. Even more preferably, the power generation will employ solar power to charge the batteries.

As an example of a preferred aspect of the invention, a customer at a vending machine scans an RFID tag embedded in their bottle. The vending machine displays an encouragement to the customer to remove the lid and pour any remaining liquid into a waste sink located on the machine. A spring loaded door to a wash chamber unlatches; the customer opens the door, and places the bottle and lid inside of the chamber. The door shuts automatically after the door is released. The RFID tag is scanned, and if confirmed, the door is latched. The chamber has an opening at the top to allow access to the interior of the bottle for both washing and filling. The chamber and bottle are rotated 180 degrees to the bottle and bottle's mouth are down for a washing cycle. A central post containing two spray nozzles (jets) is raised from below through the opening in the chamber and into the bottle interior lifting the bottle slightly so it is raised off the chamber. For about thirty seconds, jets of hot water (120° F. to 140° F.) under high pressure (1000 psi to 1400 psi) are sprayed against the interior and exterior of the bottle. The spray nozzles are located on the central post and along one corner of the wash chamber. At least one of the nozzles is angled to the bottle spins as the jets of water hit the bottle's interior and exterior surfaces. The jets of water cover the surface of the bottle. Warm chlorinated rinse water (120° F. to 140° F.) at a concentration of 50 ppm to 100 ppm is pumped for eight to twelve seconds through the same nozzles, but at a lower pressure, sanitizing the interior and exterior of the bottle. The bottle continues to spin throughout this sanitizing process. Air is drawn over the bottle and chamber to assist removal of excess water. The chamber and bottle are flipped so the mouth is up. A beverage is dispensed through the opening in the top of the chamber. The door to the wash chamber unlatches; the customer opens the door, and removes the bottle and reattaches its lid. The spring loaded door shuts automatically after the door is released, and the door latches.

Figure 13:
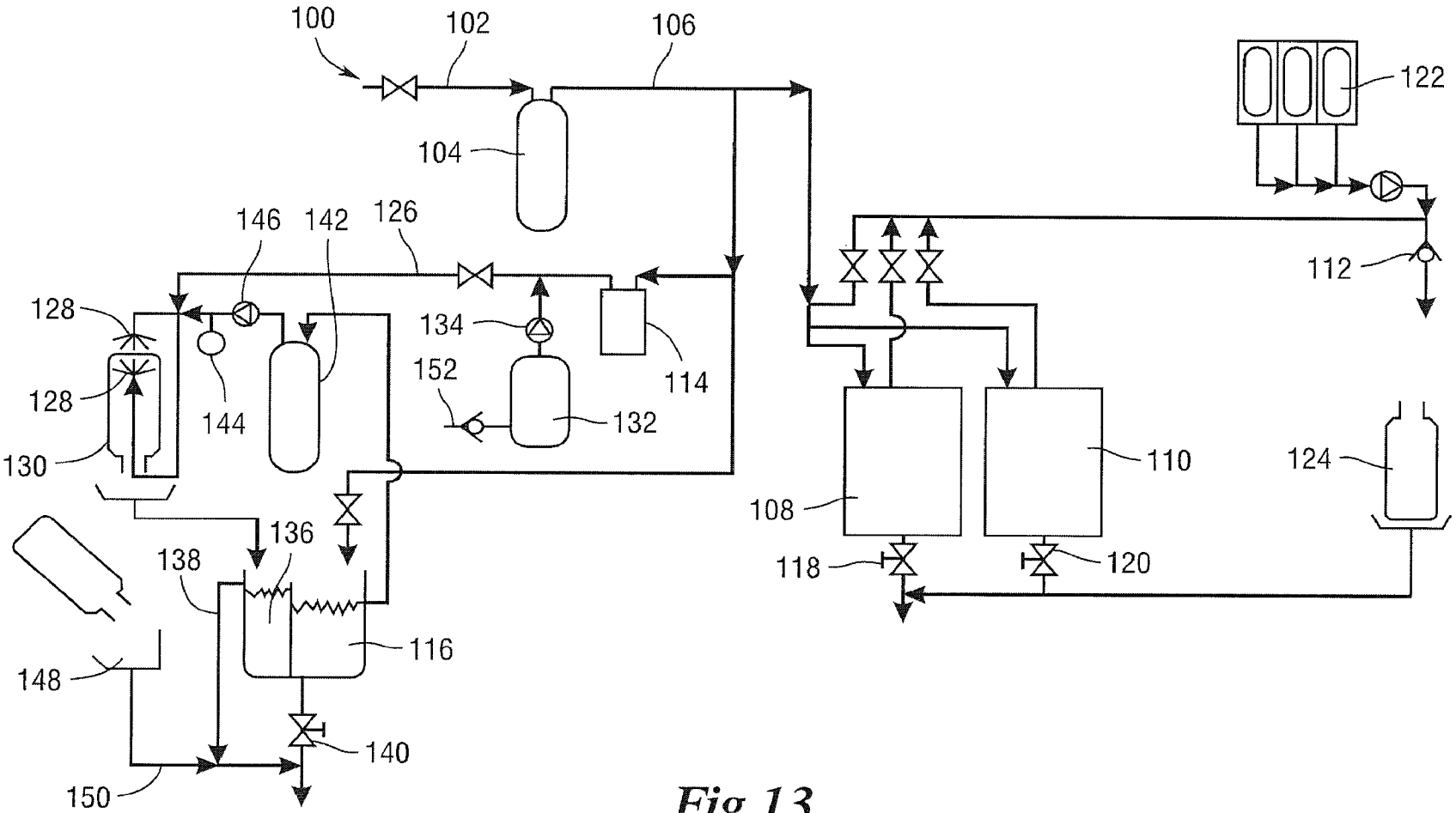
FIG. 13 is a schematic of a preferred embodiment of the present invention.

As an example, the following is a preferred piping of an embodiment of the invention illustrated in FIG. 13. Potable water (100) enters the vending machine through copper tubing (102). The potable water (100) is filtered using a filter (104) to give filtered potable water (106). The filtered potable water (106) is piped to: a four-gallon heater tank (108); a chiller tank (110); a filler valve (112); an in-line heater (114); and a two-gallon wash water heated tank (116). The four-gallon water tank (108) is connected to both a first manual drain valve (118) and to the filler valve (112). The chiller tank (110) is connected to both a second manual drain valve (120) and to the filler valve (112). The filler valve (112) dispenses hot water from the four-gallon water tank, cold water from the chiller tank (110), and syrup from syrup bags (122) into a cleaned container (124).

The in-line heater (114) is connected through a line (126) to a plurality of jets (128) for cleaning the inside and outside of a dirty container (130) to give the cleaned container (124). A tank (132) holding 3-5% chlorine solution is connected through a meter (134) to the line (126) to allow for dilution of the 3-5% chlorine solution to a 50-100 ppm chlorine solution. The 3-5% chlorine solution tank (132) is connected to an air inlet vent (152) to maintain positive pressure within the tank (132). The two rinse solutions, the hot water and the 50-100 ppm chlorine solution, are drained to a skimmer (136). The skimmer is connected to a third drain (138) and to the two-gallon heated water tank (116). The two-gallon heated water tank (116) is connected a fourth drain (140) and through a filter (142), switch (144) and pump (146) to the line (126). A waste dump (148) is connected to a fifth drain (150).

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Further, although elements of the described aspects and/or embodiments may be described or claimed in the singular, the plural is contemplated unless limitation to the singular is explicitly stated. The following claims are hereby incorporated into the Detailed Description, with each claim standing on its own as a separate embodiment.

I claim:

1. A vending machine for dispensing, receiving, cleaning and/or filling a beverage container having an opening on one end thereof and an attachable lid, the vending machine comprising:

a first wash chamber for receiving the beverage container, the first wash chamber being configured for receiving the beverage container in an opening-side-up orientation, wherein the first wash chamber is configured to be rotatable inverting the beverage container received therein to an upside down orientation;

a second wash chamber for receiving the attachable lid;

a first container cleaning jet that is configured for cleaning the beverage container's interior while the beverage container is in the first upside down orientation in the first wash chamber;

a second container cleaning jet that is configured for cleaning the beverage container's exterior while the beverage container is in the first upside down orientation in the first wash chamber;

wherein the first and second container cleaning jets spray water and/or disinfecting solution;

and a container filling means for filling the beverage container with a beverage.

2. The vending machine of claim 1 further comprising container identification means.

3. The vending machine of claim 1 further comprising:

container storage means for storing the beverage container.

4. The vending machine of claim 1 further comprising:

fluid disposal and/or recycling means for disposing and/or recycling fluids from the first and second wash chambers.

5. The vending machine of claim 1 further comprising:

computer control means interfacing with the first and second container cleaning jets.

6. The vending machine of claim 1 further comprising:

a user interface including a display screen for presenting audio and/or visual media to a user.

7. A system for dispensing, receiving, cleaning and/or filling a beverage container having an opening on one end thereof and an attachable lid, the system comprising:

a vending machine comprising a first wash chamber for receiving the beverage container, the first wash chamber being configured for receiving the beverage container in an opening-side-up orientation, wherein the first wash chamber is configured to be rotatable inverting the beverage container received therein to an upside down orientation;

a second wash chamber for receiving the attachable lid;

a first container cleaning jet that is configured for cleaning the beverage container's interior while the beverage container is in the upside down orientation in the first wash chamber;

a second container cleaning jet that is configured for cleaning the container's exterior while the beverage container is in the first upside down orientation in the first wash chamber;

wherein the first and second container cleaning jets spray water and/or disinfecting solution;

computer control means for controlling the first and second container cleaning jets and a user interface;

wherein the user interface including a display screen for presenting audio and/or visual media to a user; and a container filling means for filling the beverage container with a beverage.

8. The system of claim 7 wherein the user interface presents the audio and/or visual media while the beverage container is being received, cleaned and/or filled.

9. The system of claim 8 wherein the audio and/or visual media comprises an advertisement.

10. The system of claim 8 wherein the audio and/or visual media comprises an advertisement selected specifically for the user based upon the user's profile.

11. A method for dispensing, receiving, cleaning and/or filling a beverage container, the method comprising the steps of (a) identifying the beverage container;

(b) receiving the beverage container from a user into a first wash chamber with the beverage container in an opening-side-up orientation;

(c) receiving the attachable lid from the user into a second wash chamber;

(d) inverting the beverage container into an upside down orientation by rotating the first wash chamber;

(e) cleaning the beverage container and the attachable lid;

(f) dispensing the beverage container, and further comprising a playing of audio and/or visual media during at least one of the steps (a) through (f).

12. The method of claim 11 wherein the audio and/or visual media comprises an advertisement targeting the user.

13. The method of claim 11 further comprising the step of filling the beverage container with a beverage.

14. The method of claim 11, wherein the step of cleaning the beverage container further comprises washing the container with angled jets of fluid which rotates the beverage container during the cleaning step.

15. The vending machine of claim 1, wherein at least one of the first and second container jets is disposed at an angle such that the container rotates on a longitudinal axis of the container.

16. The vending machine of claim 15, wherein the angle is oblique to the longitudinal axis.

17. The system of claim 7, wherein at least one of the first and second container jets is disposed at an angle such that the container rotates on a longitudinal axis of the container.

18. The system of claim 17, wherein the angle is oblique to the longitudinal axis.

* * * * *